US007178266B2

(12) United States Patent
Deem et al.

(10) Patent No.: US 7,178,266 B2
(45) Date of Patent: Feb. 20, 2007

(54) AIR CIRCULATING SHOE

(75) Inventors: John Deem, Sharon, MA (US); Arthur Cintron, Marlborough, MA (US); Jason Boie, Walpole, MA (US); Roy Hayes, Kentwood, MI (US)

(73) Assignee: The Rockport Company, LLC, Canton, MA (US)

( * ) Notice: Subject to any disclaimer, the term of this patent is extended or adjusted under 35 U.S.C. 154(b) by 122 days.

(21) Appl. No.: 11/005,031

(22) Filed: Dec. 7, 2004

(65) Prior Publication Data

US 2006/0117599 A1 Jun. 8, 2006

(51) Int. Cl.
*A43B 13/12* (2006.01)

(52) U.S. Cl. ..... 36/3 B; 36/3 R

(58) Field of Classification Search ..... 36/3 B, 36/3 R, 3 A

See application file for complete search history.

(56) References Cited

U.S. PATENT DOCUMENTS

| | | | |
|---|---|---|---|
| 80,934 | A | 8/1868 | Ferry |
| 220,475 | A | 10/1879 | Hannaford |
| 363,377 | A | 8/1887 | Faye, Jr. |
| 393,563 | A | 11/1888 | Howard |
| 417,858 | A | 12/1889 | Church |
| 896,488 | A | 8/1908 | Valiant |
| 997,658 | A | 7/1911 | Duncan |
| 1,128,391 | A | 2/1915 | Valiant |
| 1,202,827 | A | 10/1916 | Gerhold |
| 1,317,161 | A | 9/1919 | Hay |
| 1,742,772 | A | 1/1930 | Langan et al. |
| 1,852,883 | A | 4/1932 | Gustaveson |
| 1,932,557 | A | 10/1933 | Meucci |
| 1,971,223 | A | 8/1934 | Kamrass |
| 1,974,456 | A | 9/1934 | Goldzweig |
| 2,098,412 | A | 11/1937 | Bovay |
| 2,239,211 | A | 4/1941 | Wylie |
| 2,356,490 | A | 8/1944 | Crotty |
| 2,474,815 | A | 7/1949 | Brahm |
| 2,720,041 | A | 10/1955 | Kajtar |
| 2,751,692 | A | 6/1956 | Cortina |
| 3,256,621 | A | 6/1966 | Linton |
| 4,000,566 | A | 1/1977 | Famolare, Jr. |

(Continued)

FOREIGN PATENT DOCUMENTS

DE 20 2004 008 539 U1 9/2004

(Continued)

OTHER PUBLICATIONS

International Search Report dated Apr. 18, 2006, in International Application No. PCT/US2002/044109.

*Primary Examiner*—Ted Kavanaugh
(74) *Attorney, Agent, or Firm*—Sterne, Kessler, Goldstein & Fox P.L.L.C.

(57) ABSTRACT

A shoe with increased air circulating properties that includes an upper, a sole assembly, waterproof layer and a footbed. A shank that includes at least one vent is incorporated into the sole assembly. A plurality of air circulation channels are also provided in the sole assembly that are placed in fluid communication with at least one vent of the shank. Ventilation holes are further provided in the footbed and the footbed is located over the waterproof layer which is located on or in the shank to provide a liquid barrier.

10 Claims, 11 Drawing Sheets

U.S. PATENT DOCUMENTS

| | | | |
|---|---|---|---|
| 4,063,371 | A | 12/1977 | Batra |
| 4,078,321 | A | 3/1978 | Famolare, Jr. |
| 4,100,685 | A | 7/1978 | Dassler |
| 4,438,573 | A | 3/1984 | McBarron |
| 4,499,672 | A | 2/1985 | Kim |
| 4,617,745 | A | 10/1986 | Batra |
| 4,654,982 | A | 4/1987 | Lee |
| 4,813,160 | A | 3/1989 | Kuznetz |
| 4,837,948 | A | 6/1989 | Cho |
| 4,860,463 | A | 8/1989 | Pin |
| 4,910,887 | A | 3/1990 | Turner et al. |
| 4,912,858 | A | 4/1990 | Mochizuki |
| 4,939,851 | A | 7/1990 | Miller |
| 5,044,096 | A | 9/1991 | Polegato |
| 5,584,130 | A | 12/1996 | Perron |
| 5,588,226 | A | 12/1996 | Schenkel |
| 5,598,644 | A | 2/1997 | Polegato |
| 5,619,809 | A | 4/1997 | Sessa |
| 5,675,914 | A | 10/1997 | Cintron |
| 5,983,524 | A | 11/1999 | Polegato |
| 5,983,525 | A | 11/1999 | Brown |
| 5,992,052 | A | 11/1999 | Moretti |
| 6,006,447 | A | 12/1999 | Neal et al. |
| 6,041,519 | A | 3/2000 | Cheng |
| 6,196,556 | B1 | 3/2001 | Bonaventure et al. |
| 6,305,100 | B1 | 10/2001 | Komarnycky et al. |
| 6,408,541 | B1 | 6/2002 | Moretti |
| 6,467,191 | B2 | 10/2002 | Hayashi et al. |
| 6,553,690 | B2 | 4/2003 | Di Girolamo |
| 6,655,048 | B2 | 12/2003 | Moretti |
| 6,681,500 | B2 | 1/2004 | Moretti |
| 6,817,112 | B2 | 11/2004 | Berger et al. |
| 2002/0017036 | A1 | 2/2002 | Berger et al. |
| 2004/0148800 | A1 | 8/2004 | Nakano |
| 2005/0126036 | A1* | 6/2005 | Wu ..... 36/3 B |

FOREIGN PATENT DOCUMENTS

| | | | |
|---|---|---|---|
| EP | 1 424 018 | A1 | 6/2004 |
| WO | WO 2004/004504 | A1 | 1/2004 |
| WO | WO 2004/028284 | A1 | 4/2004 |

* cited by examiner

AIR CIRCULATING SHOE

BACKGROUND OF THE INVENTION

1. Field of the Invention

The field of this invention generally relates to shoes, and more particularly to a shoe that allows air circulation.

2. Background of the Invention

Shoes are generally designed to provide protection and cushioning to a user's feet. However, many shoes may also provide an unfavorable environment for the user's feet, especially where the shoes do not allow for adequate air circulation.

A shoe that lacks adequate air circulation may be both uncomfortable and unhealthy. Improper circulation often creates excessively hot and humid conditions within shoes. Such conditions may contribute to the development of fungus and/or bacteria which may lead to discomfort and/or foot odor. In addition, the excessive heat and humidity may create further discomfort caused by blisters and/or muscle fatigue.

Shoes that provide air circulation allow for normal body cooling and prevent excessive heat and humidity within the shoes. As a result, increasing air circulation in a shoe may dramatically reduce the likelihood of the user developing fungal infections, bacterial infections, foot odor, blisters, and/or muscle fatigue.

Shoes designed to address this problem have provided only partial solutions. In one design, an elastically deformable pad is inserted in a heel portion of the sole in a shoe. Ventilation channels extend along the length of the sole from the deformable pad to a toe region. A plurality of valves are the sole from the deformable pad to a toe region. A plurality of valves are included in the channels. The valves are configured so that air is ejected from the shoe to the environment when the pad is compressed and hot air in the toe portion is drawn back to the heel portion when the pad is decompressed. The hot air can then be ejected with the next pad compression.

Another ventilated shoe design includes a sole that incorporates lateral openings and a compressible insert in a heel portion. A gasket that is permeable to air but not to water is interposed between the lateral openings and the insert. The heel insert includes ducts that communicate with ducts that extend through the area of the plantar arch and toward the toes. The heel insert is designed to act as a pump with compression and decompression caused by normal foot motion.

Yet another shoe designed to increase the air circulation in a shoe incorporates an insole, a cushion, and a midsole forming a layered structure; holes that extend through the layered structure in a forefoot region; and an outsole that includes a plurality of airways. The holes communicate with airways in an outsole. Directional valves are included that allow air within the forefoot portion to flow to the environment when a user compresses the outsole.

One simplified ventilation system for shoes incorporates holes located in an arch portion through an upper. A waterproof breathable membrane is attached to the upper and covers the holes. The shoe also includes an insole that has channels in the bottom side that are aligned with the holes in the upper so that air passing through the membrane enters the channels. Compression and decompression of the insole by the user causes the air to circulate through the channels and through holes in the insole.

The shoes described above present significant disadvantages. First, the configuration of the valves and waterproof membranes severely restrict the ability of heated, water-vapor laden air to flow through the shoe. As a result, the volume of air that is available for heat transfer and evacuation of humidity is significantly reduced. In addition, the designs are dependent on the compression of the shoe to act as a pump to force air through the shoes. Natural drafts would have virtually no impact on circulation through the shoe since they would not provide sufficient force to pass through the valves and flow through the membranes is significantly reduced.

Accordingly, there is a need for a shoe that is capable of efficiently providing air circulation throughout the shoe without requiring the sole of the shoe to be compressed.

SUMMARY OF THE INVENTION

In an embodiment of the present invention, an air circulating shoe includes an upper, a midsole coupled with the upper, a shank, an outsole coupled with the midsole, a waterproof layer, and a removable footbed. The shank is partially enclosed between the midsole and the outsole and includes a vent frame that defines a vent. The midsole includes a vent passage extending through a thickness of the midsole that is aligned with the vent frame of the shank. The outsole includes a vent notch that is also aligned with said vent frame of the shank. The waterproof layer is configured so that it covers the vent passage of the midsole and is coupled with a top surface of the midsole. The removable footbed is located on top of the waterproof layer.

In another embodiment, an air circulating shoe includes an upper, a midsole coupled with the upper, a shank having a vent frame that defines a vent that is located adjacent to a midfoot support portion, a plurality of vent fins disposed in the vent, an outsole coupled with the midsole, a waterproof layer, and a removable footbed. The plurality of vent fins define a plurality of vent apertures and the vent fins are angled such that they splay outwardly toward a leading edge of the shank. The midsole includes a vent passage located in a midfoot portion that extends through a thickness of the midsole. The outsole includes a vent notch aligned with the vent frame. The waterproof layer covers the vent passage and is coupled with a top surface of the midsole. The removable footbed is located on top of the waterproof layer.

In a further embodiment of the present invention, an air circulating shoe includes an upper, a midsole coupled with the upper, a shank, an outsole coupled with the midsole, a waterproof textile material, and a removable footbed. The midsole includes a plurality of vent passages located in a midfoot portion that extend through a thickness of the midsole, a circulation channel on a top surface of the midsole, and a shank recess on a bottom surface of the midsole. The shank has a plurality of vent frames that define a plurality of vents that are adjacent to a midfoot support portion of the shank. In this embodiment, the shank is located in the shank recess and partially enclosed between the midsole and the outsole. A plurality of vent fins are located in the plurality of vents defining a plurality of vent apertures and the fins are angled such that they splay outward toward a leading edge of the shank. The outsole includes a plurality of vent notches aligned with the plurality of vent frames of the shank. The waterproof textile material covers the plurality of vent passages of the midsole and is coupled with the top surface of the midsole. The removable footbed is located on top of the waterproof textile material.

In another embodiment of the present invention, an air circulating shoe includes an upper, a unit sole coupled with the upper, a shank, a waterproof layer, and a removable footbed. The unit sole includes a midsole portion and an outsole portion and is coupled with the upper. The shank is coupled to the unit sole and includes a vent frame that defines a vent that is configured to provide a throughway into the interior of the shoe from the environment. The waterproof layer covers the vent and is coupled with a top surface of the unit sole.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

BRIEF DESCRIPTION OF THE DRAWINGS/FIGURES

Features, aspects and advantages of the present invention will become better understood with reference to the following description, appended claims, and accompanying drawings, which are not to scale.

DETAILED DESCRIPTION OF THE INVENTION

The present invention is now described with reference to the figures where like reference numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention.

Figure 1:
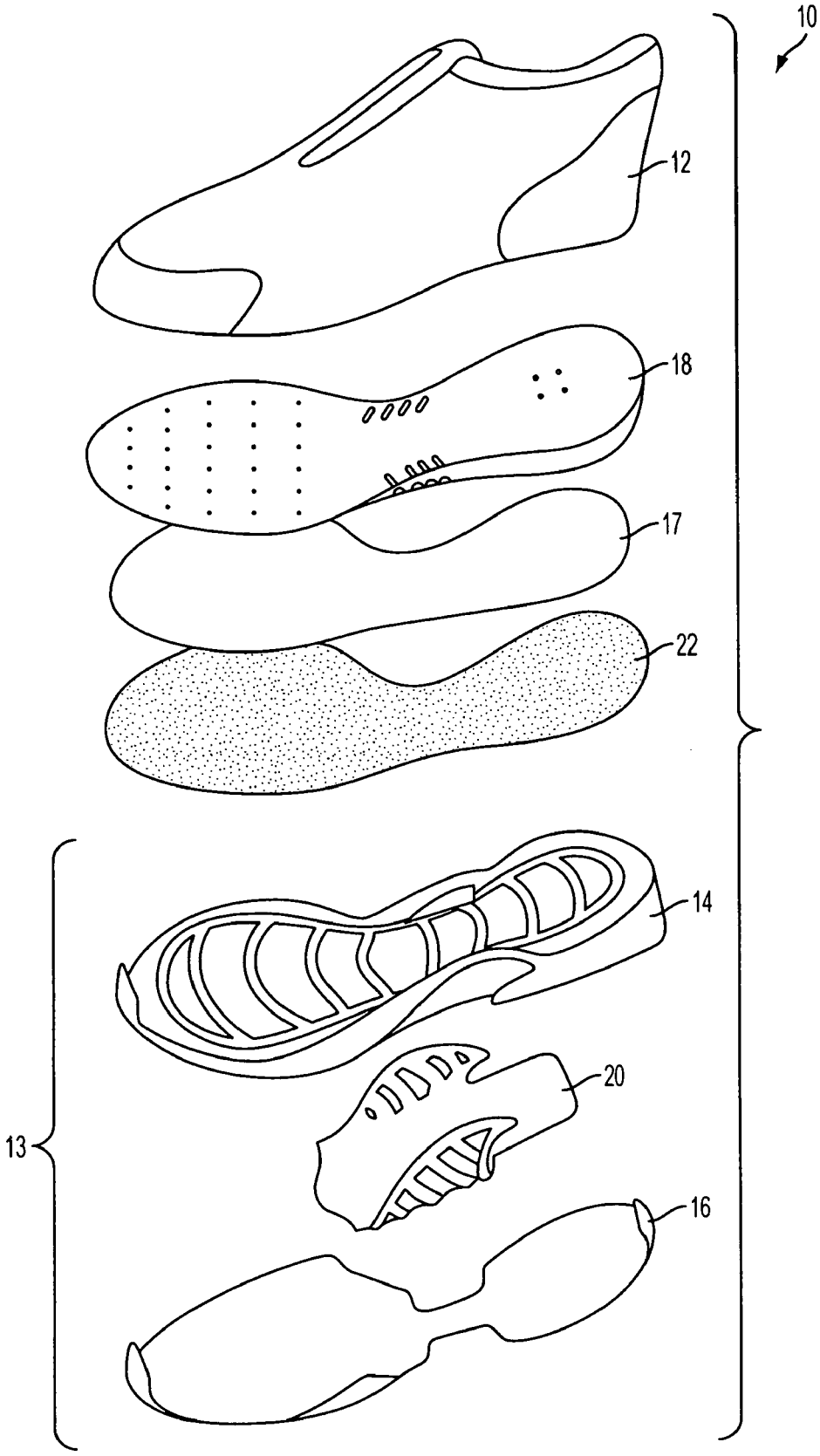
FIG. 1 is an exploded view of an air circulating shoe.

An air circulating shoe 10 according to the present invention is shown in FIG. 1. Shoe 10 generally includes an upper 12, a sole assembly 13, a footbed 18, a waterproof layer 22 and an insole 17. Sole assembly 13 is constructed from a midsole 14, an outsole 16, and a shank 20.

Upper 12 is a conventional upper, known in the art. It may be made of any material known in the art that is appropriate for the upper of a shoe, and it may, or may not, be waterproof. For example, upper 12 may be constructed from leather, cloth, vinyl, or plastic.

Figure 2:
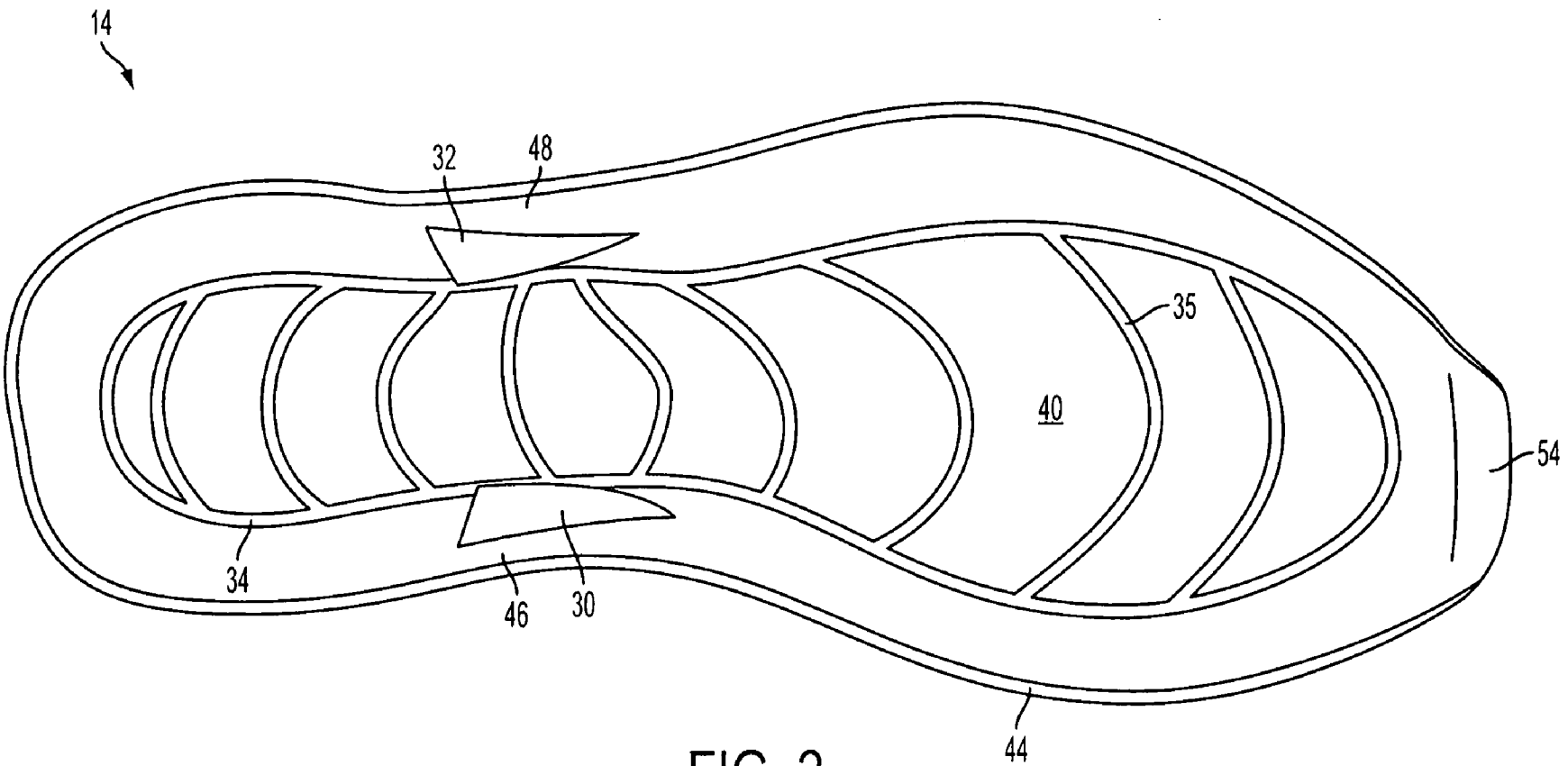
FIG. 2 is a top view of the midsole of the air circulating shoe of FIG. 1.
Figure 3:
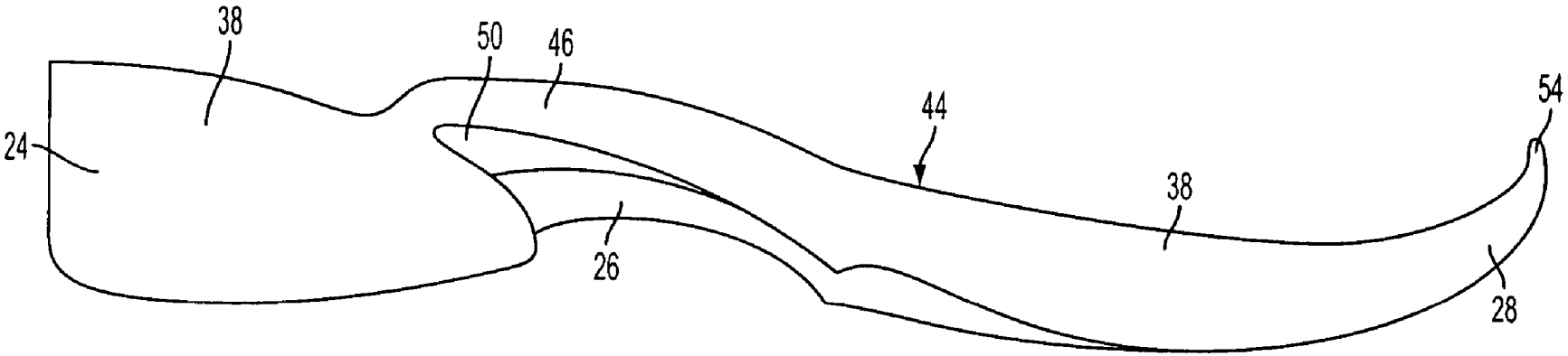
FIG. 3 is a side view of the midsole of the air circulating shoe of FIG. 1.
Figure 4:
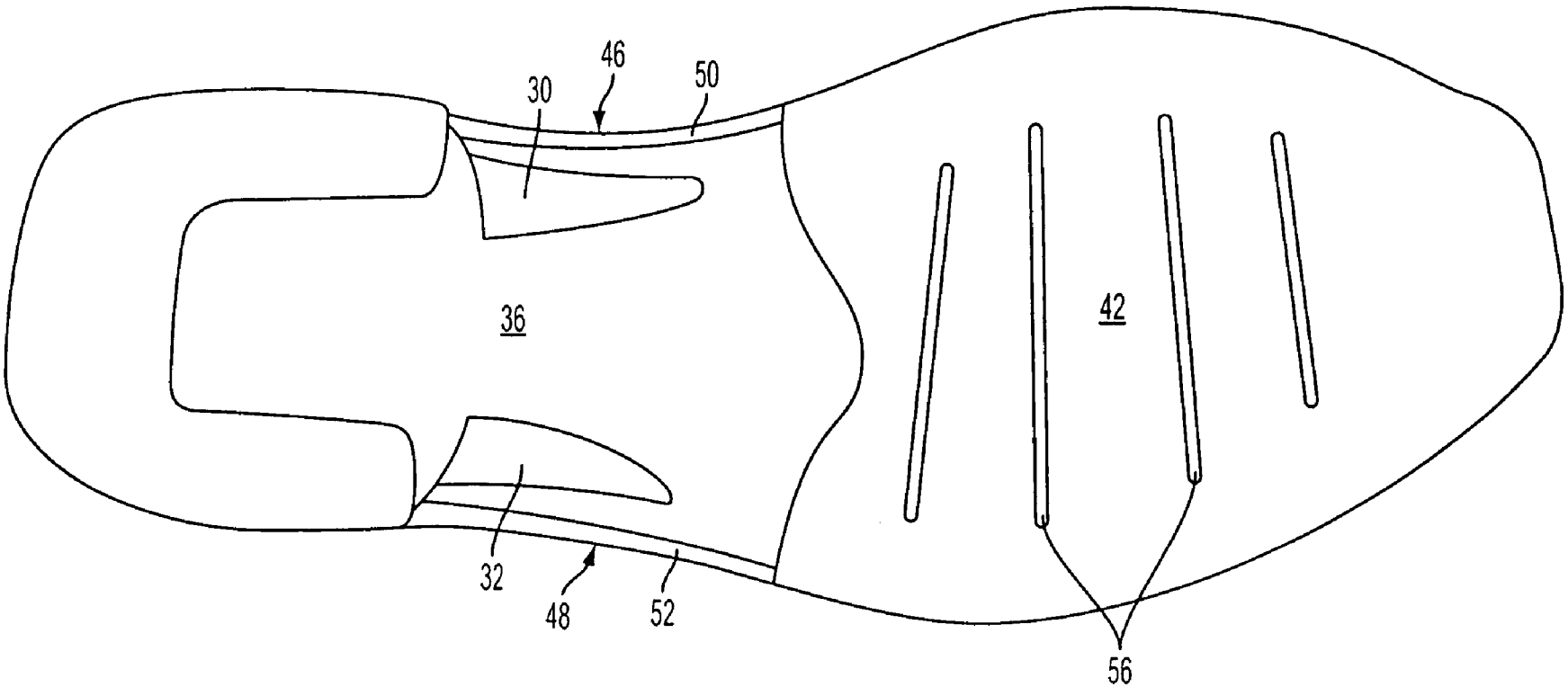
FIG. 4 is a bottom view of the midsole of the air circulating shoe of FIG. 1

Midsole 14 is one component of sole assembly 13 and is shown in greater detail in FIGS. 2–4. Midsole 14 includes a heel portion 24, a midfoot portion 26 and a forefoot portion 28 each of which corresponds generally to a portion of a user's foot. Heel portion 24 is generally the thickest portion of midsole 14 and cushions the heel of a user of shoe 10. Heel portion 24 may be contoured to match the contour of a user's foot.

Forefoot portion 28 corresponds with the forefoot of a user of shoe 10 and cushions the ball and toes of the user's foot. Forefoot portion 28 includes a series of flex grooves 56 that are recessed from a bottom surface 42 of midsole 14. A toe bumper 54 may be integrated into forefoot portion 28 of midsole 14 at the end of forefoot portion 28 furthest from midfoot portion 26. Toe bumper 54 is configured to protect upper 12 and the user's foot during frontal impacts with foreign objects.

Midfoot portion 26 of midsole 14 is located between heel portion 24 and forefoot portion 28 and corresponds generally to the arch of the user's foot. Midfoot portion 26 includes a medial vent passage 30, a lateral vent passage 32 and a shank recess 36. Medial vent passage 30 and lateral vent passage 32 are apertures that extend through the thickness of midsole 14 and create a medial vent rail 46 and a lateral vent rail 48, respectively. It shall be appreciated that medial vent passage 30 and lateral vent passage 32 may be formed by notches that extend transversely into midsole 14 from a sidewall 38. Shank recess 36, shown in FIG. 4, is recessed from bottom surface 42 of midsole 14. Shank recess 36 is configured to receive shank 20, which will be described in greater detail below. Shank recess 36 extends to medial vent rail 46 and lateral vent rail creating a medial vent seat 50 and a lateral vent seat 52.

Midsole 14 may be contoured to improve the comfort and support provided by shoe 10. For example, a top surface 40 of midsole 14 may be generally concave with a raised midsole border 44. In addition, midsole 14 may include a peripheral circulation channel 34 and a plurality of transverse circulation channels 35 recessed from top surface 40 of midsole 14. Peripheral circulation channel is a narrow channel configured so that it forms a continuous loop and is generally parallel with midsole border 44 around the perimeter of midsole 14. Peripheral circulation channel intersects with medial vent passage 30 and lateral vent passage 32. Transverse circulation channels 35 extend transversely across midsole 14 extending from a medial portion of peripheral circulation channel 34 to a lateral portion of peripheral circulation channel 34. Air entering medial vent passage 30 and lateral vent passage 32 is free to flow into an air circulation network created by peripheral circulation channel 34 and transverse circulation channels 35.

The construction of midsole 14 is similar to other midsoles known in the art, where the function thereof is to cushion the foot during the step. As such, the characteristics of midsole 14 will vary according to the intended use of shoe 10. For example, midsole 14 may be relatively thick and resilient in an athletic shoe, while midsole 14 may be relatively thin in a dress shoe. Midsole 14 may be made from any material known in the art that is appropriate for a midsole, such as ethyl vinyl acetate (EVA), either injection, poured, or compression molded, rubber, polyurethane (PU) foam, or thermoplastic polyurethane (TPU). For the purposes of example only, in one embodiment shoe 10 is an athletic shoe. Midsole 14 in a preferred embodiment is made from compression molded EVA, having a durometer measurement between 45 and 80 on an Asker C scale. Additionally, the hardness of midsole 14 may vary along the length thereof. For the purposes of example only, in one embodiment the midsole material durometer measurements are approximately 60–65 Asker C.

Figure 5:
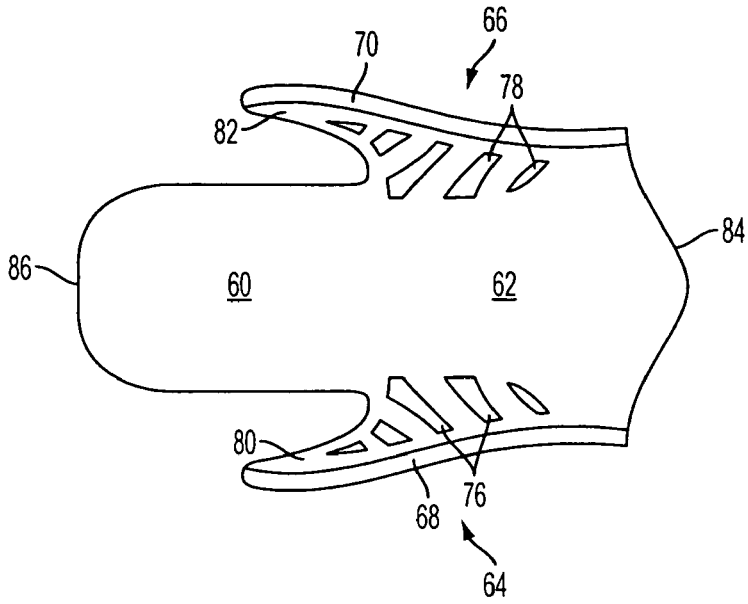
FIG. 5 is a top view of the shank of the air circulating shoe of FIG. 1.
Figure 6:
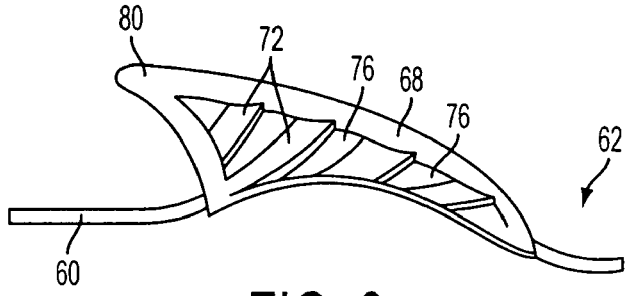
FIG. 6 is a side view of the shank of the air circulating shoe of FIG. 1.
Figure 7:
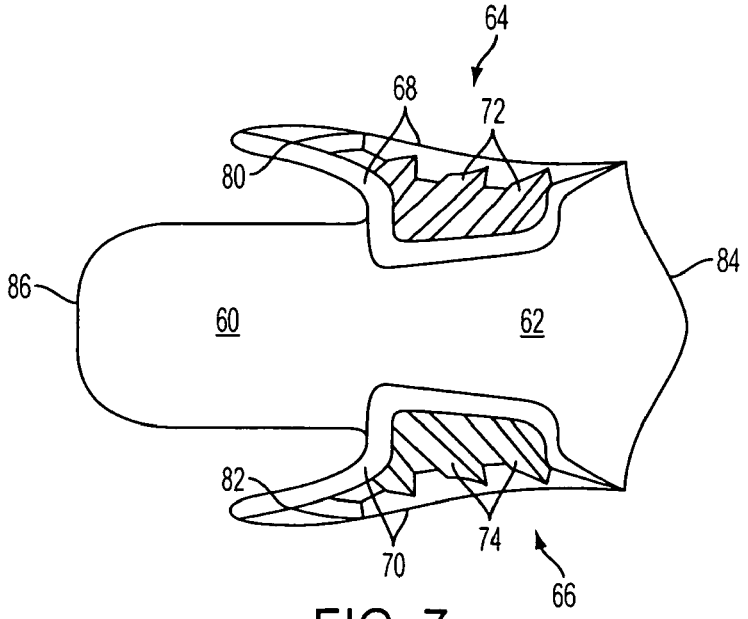
FIG. 7 is a bottom view of the shank of the air circulating shoe of FIG. 1.

Sole assembly 13 also includes shank 20, shown in FIGS. 5–7. Shank 20 is located adjacent to midfoot portion 26 of midsole 14 and generally includes a heel support portion 60, a midfoot support portion 62, a medial vent frame 68, and a lateral vent frame 70. Medial vent frame 68 and lateral vent frame 70 extend from midfoot support portion 62 and define a medial vent 64 and a lateral vent 66, respectively.

A plurality of medial vent fins 72 and lateral vent fins 74 are included within medial vent 64 and lateral vent 66. The vent fins create a series of medial vent apertures 76 and lateral vent apertures 78 that allow air to flow through medial vent 64 and lateral vent 66. The fins may be oriented to direct air through the vent apertures. For example, as shown, the fins are splayed outward toward a leading edge 84 of shank 20. In that configuration, when a user takes a step forward, the fins would guide air into medial and lateral vent apertures 76, 78. The vent fins may alternatively be configured substantially parallel or they may be configured so that they splay outward toward a trailing edge 86 of shank 20. As a further alternative, one or more of the fins in one vent may be oriented differently from the others fins in that vent. For example, a group of the medial vent fins may be oriented such that they are splayed outward toward the leading edge of the shank while the remaining medial vent fins are splayed outward toward the trailing edge of the shank.

Shank 20 is configured to provide desired stiffness to the midfoot of the user of shoe 10. The thickness and shape of heel support portion 60 and midfoot support portion 62 may be adjusted to change the stiffness of each portion. In addition, since the vent frames will affect the stiffness of shank 20, the configuration of medial and lateral vent frames may be altered to customize the stiffness of shank 20. For example locating medial vent frame 72, lateral vent frame 70, medial vent fins 72, and lateral vent fins 74 adjacent to and extending from midfoot support portion 62 may increase the stiffness of midfoot support portion 62. As shown, shank 20 includes a medial vent wing 80 and a lateral vent wing 82 that extend toward trailing edge 86 of shank 20. The vent wings allow the size of medial vent 64 and lateral vent 66 to be increased without affecting the stiffness of heel support portion 60. Shank 20 may include any number of vents located within or extending from any portion of the shank.

In one embodiment, shank 20 is constructed from injection molded TPU. Other thicknesses and similar materials, including composites, filled and non-filled nylons, similar structural plastics, and die cut sheet stock of various materials, may also be used. Other suitable materials include thermoplastic elastomer (TPE), EVA, and ENGAGE polyolefin elastomer. The shank may be thermoformed, such as by injection molding or extruding. The thickness of the shank may vary, for example the thickness of the shank may be between 2 and 8 mm.

Figure 8:
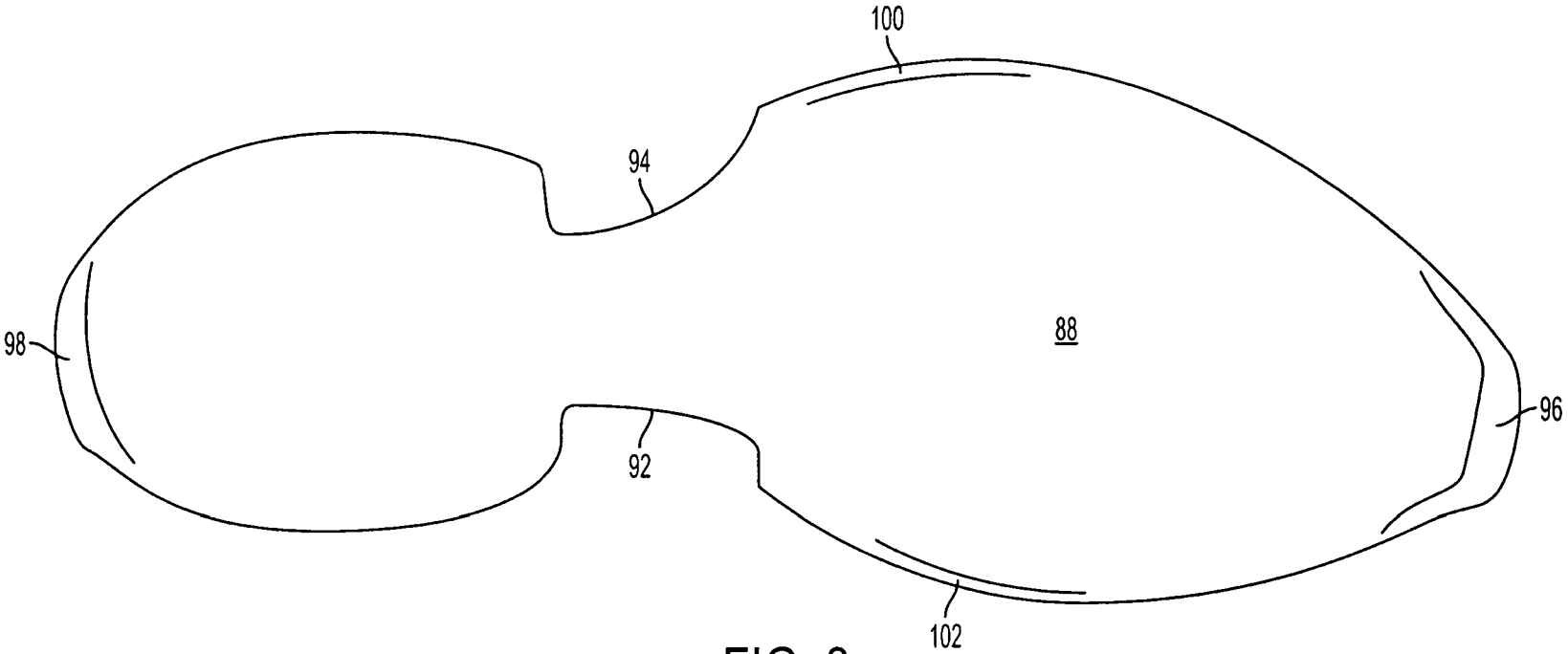
FIG. 8 is a top view of the outsole of the air circulating shoe of FIG. 1.
Figure 9:
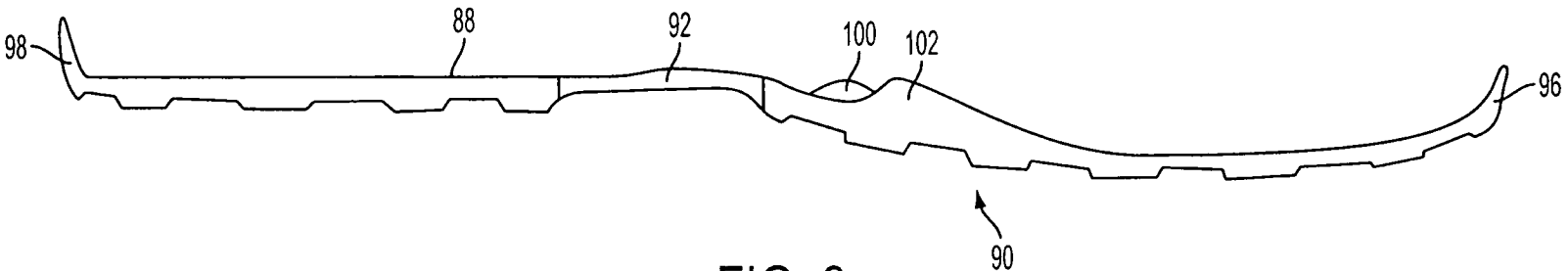
FIG. 9 is a side view of the outsole of the air circulating shoe of FIG. 1.

The bottom-most component of the sole assembly 13 is outsole 16, shown in FIGS. 8 and 9. Outsole 16 includes a medial vent notch 92, a lateral vent notch 94 and a bottom tread surface 90. Medial vent notch 92 and lateral vent notch 94 extend through outsole 16 from a top surface 88 to bottom tread surface 90. A toe bumper 96 is located at a toe end of outsole 16 and a heel bumper 98 is located at a heel end of outsole 16. A medial bumper 102 and a lateral bumper 100 are also included on outsole 16 on medial and lateral sides, respectively.

Outsole 16 may be made of rubber, PU, rubberized EVA, EVA, leather or a similar resilient, wear-resistant material. As is well-known in the art, outsole 16 may include treads for increasing traction. As will be recognized by those skilled in the art, treads may be various shapes and have various arrangements. For example, treads could be ridges, waves, or the like, or any pattern of discrete nubs.

Waterproof layer 22 is coupled with top surface 40 of midsole 14 and provides a barrier so that liquid passing through the vents cannot contact the user's foot. Waterproof layer 22 is constructed to create a barrier to the passage of liquid while allowing gases, such as air and water vapor, to pass through. Waterproof layer 22 may be a waterproof textile material, a membrane material that is waterproof and vapor-permeable, or it may be a perforated film such as a thermoplastic.

Figure 10:
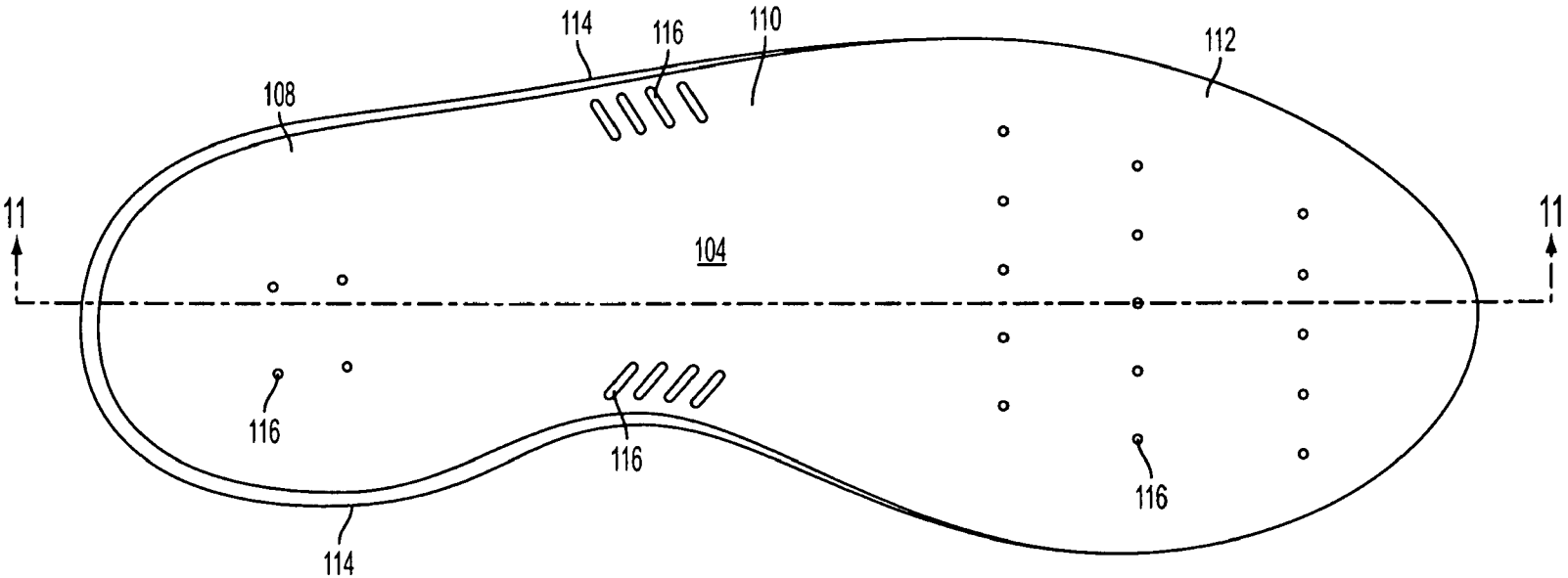
FIG. 10 is a top view of the footbed of the air circulating shoe of FIG. 1.
Figure 11:
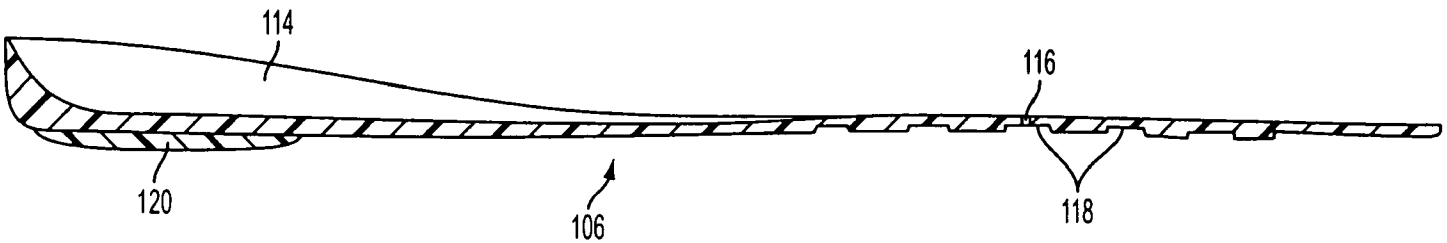
FIG. 11 is a cross-sectional view of the footbed of FIG. 10 taken along line 11—11.

Footbed 18, shown in FIGS. 10 and 11, is located within upper 12 on top of waterproof layer 22. Footbed 18 is provided to improve the comfort of shoe 10 for the user. Footbed 18 includes a heel portion 108, a midfoot portion 110, and a forefoot portion 112. A heel cushion 120 may be included in heel portion 108 of footbed 18 to provide improved comfort and energy return properties to the heel of the user. A series of ventilation channels 118 is also incorporated in footbed 18. Ventilation channels 118 are recessed into footbed 18 from a bottom surface 106 and may extend through any part of footbed 18. Ventilation channels 118 are fluidly connected with a series of ventilation holes, or slits, 116 that extend through the thickness of footbed 18 and may be positioned at any location in footbed 18. Ventilation holes 116 may also be located on footbed 18 to correspond vents 64 and 66. Water vapor is free to flow through ventilation holes 116 in footbed 18 and ventilation channels 118. The vapor may then pass through waterproof layer 22 and out through vents 64 and 66. Footbed 18 may also include a raised peripheral edge 114 for added stability and to improve comfort.

Footbed 18 is made of a soft resilient material covered on a top surface 104 with an abrasion-resistant, durable material to protect the resilient material from damage. The resilient material may be of any type known in the art for use as a footbed, such as PU, EVA, latex, polyethylene, or similar materials. The durable material may be any type known in the art, such as woven or pressed fabrics or leather. The durable material may also provide absorbent properties, anti-bacterial properties, anti-microbial and/or anti-fungal properties for additional comfort and to guard the health of the user.

Insole 17 is located between waterproof layer 22 and footbed 18. Insole 17 may be a lasting board or Strobel material and it may extend the full length of shoe 10 (as shown) or just a portion. Insole 17 may be attached to midsole 14 by any conventional method, such as by stitching. Insole 17 may be made of a perforated or vapor-permeable material. It should be understood that shoe 10 may alternatively be constructed without insole 17.

Figure 12:
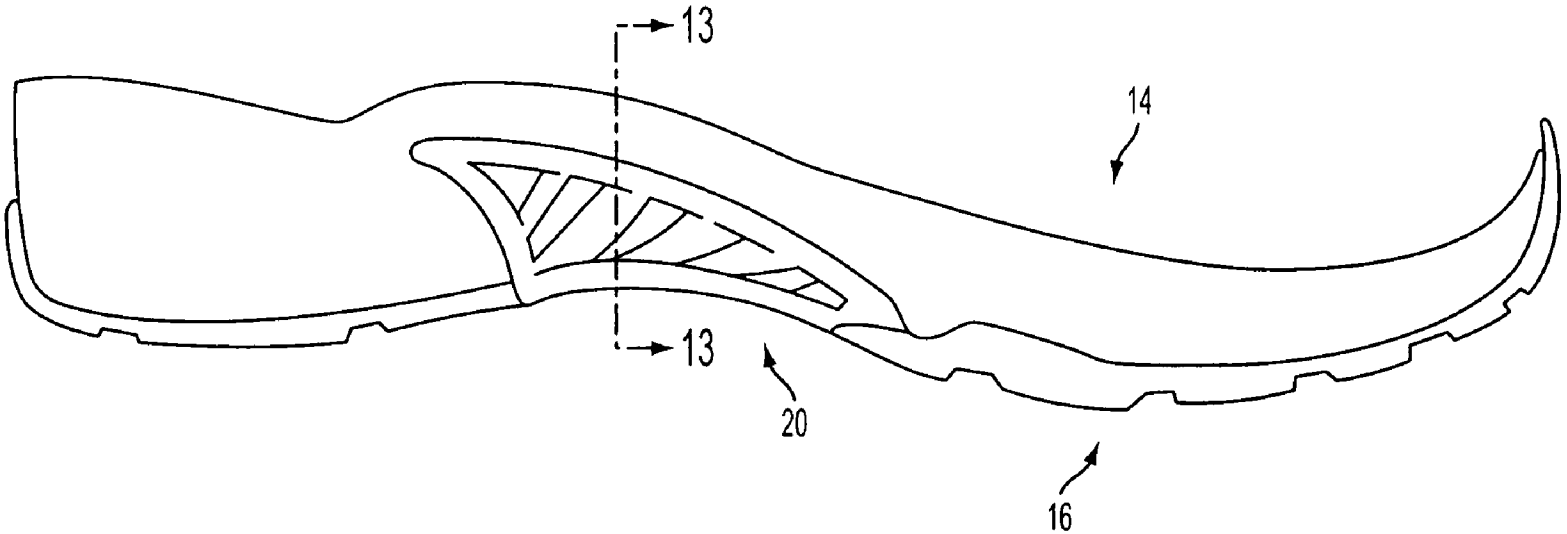
FIG. 12 is a side view of a sole assembly of the air circulating shoe of FIG. 1.
Figure 13:
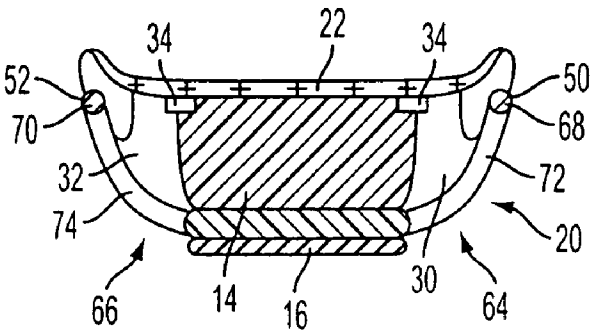
FIG. 13 is a cross-sectional view of the sole assembly of FIG. 12 taken along line 13—13.

As previously described, sole assembly 13 includes midsole 14, outsole 16, and shank 20. FIGS. 12 and 13 illustrate the interaction of the components of sole assembly 13 and its combination with waterproof layer 22. As shown, midsole 14 is the major component of sole assembly 13. Shank 20 is coupled with midsole 14 so that medial vent frame 68 abuts medial vent seat 50 and lateral vent frame 70 abuts lateral vent seat 52. Shank 20 and midsole 14 are also aligned so that medial vent 64 and medial vent passage 30 are placed in fluid communication with each other and lateral vent 66 and lateral vent passage 32 are placed in fluid communication with each other. Outsole 16 is then coupled with and aligned with midsole 14 and shank 20 so that medial vent notch 92 aligns with medial vent 64 and lateral vent notch 94 aligns with lateral vent 66. Waterproof layer 22 is coupled with top surface 40 of midsole 14 so that it covers peripheral circulation channel 34, transverse circulation channels 35, medial vent passage 30 and lateral vent passage 32.

Medial vent 64 and lateral vent 66 allow water vapor to escape from shoe 10. Heated, water-vapor laden air that passes through waterproof layer 22 from the user's foot may enter transverse circulation channels 35 and peripheral circulation channel 34 of the air circulation network. Because peripheral circulation channel 34 intersects the vent passages, the heated air in the air circulation network may then enter medial vent passage 30 and lateral vent passage 32. Once the heated air is in the vent passages it is then free to flow out to the surrounding environment.

Although shoe 10 may be any type of shoe known in the art, such as an athletic shoe, or a dress shoe for example. Shoe 10 incorporates a construction that is particularly well-suited to an athletic shoe. During athletic use, foot temperature increases and creates a greater need for providing cooling and evacuation of water-vapor created by perspiration. Shank 20, with the splayed medial and lateral vent fins 72 and 74, is configured such that forward movement of the shoe guides air from the surrounding environment into the air circulation network through medial and lateral vents 64 and 66 to increase the mixing between cool air and the heated, vapor laden air. In addition, the placement of waterproof layer 22 is such that the air entering medial and lateral vents 64 and 66 does not have to pass through waterproof layer 22 prior to entering peripheral channel. As a result, water-vapor may diffuse through waterproof layer 22 over a greater surface area and the cooler air may extend further into the air circulation network prior to becoming heated. The location of medial and lateral vents 64 and 66 also improves the cooling and water-vapor evacuating features of shoe 10. The central location of the vents creates a shorter path for water vapor from the toe and heel extremities to exit shoe 10. In addition, since medial vent 64 and lateral vent 66 extend onto the side of sole assembly 13 they allow water-vapor to exit the shoe even when the shoe is placed on a surface.

In order to further improve circulation, water proof layer 22 may not cover the entire circulation network. For example, the waterproof layer may extend over the medial vent passage, the lateral vent passage, and a portion of the peripheral circulation channel. The amount of coverage of the waterproof layer is dependent on the design of shank 20 since the likelihood of water passing through the medial and lateral vents is dependent thereon.

Figure 14:
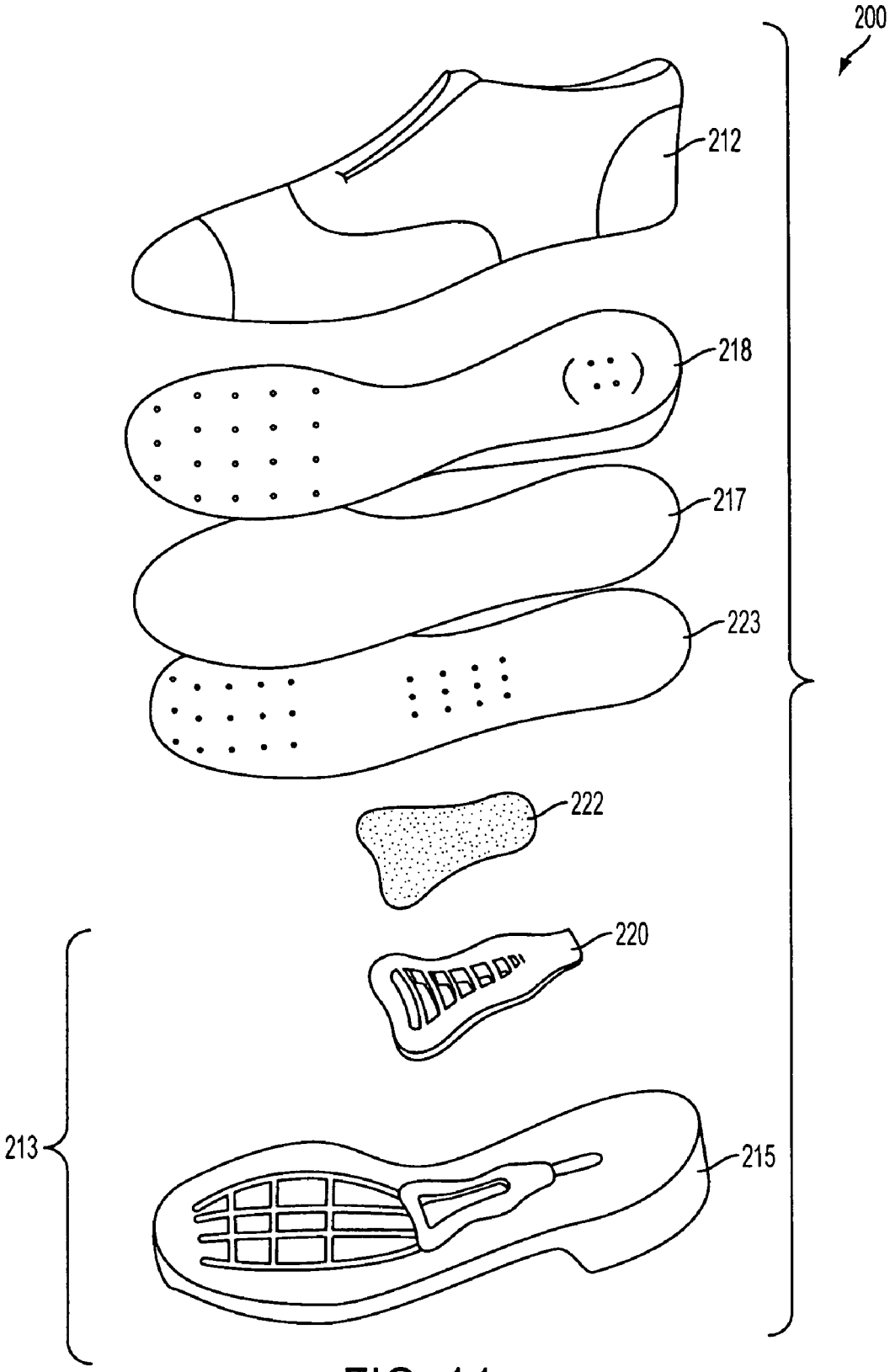
FIG. 14 is an exploded view of another embodiment of the air circulating shoe.

Another embodiment of the present invention is shown in FIG. 14. Similar to shoe 10 of FIG. 1, shoe 200 includes an upper 212, a sole assembly 213, a footbed 218, a waterproof layer 222 and an insole 217. Shoe 200 may, but need not, also include a thermal barrier 223, as shown. Sole assembly 213 includes a unit sole 215 and a shank 220. Unit sole 215 provides the functional characteristics of an outsole and a midsole. It should be appreciated that upper 212 may be made of any material known in the art that is appropriate for the upper of a shoe, such materials include leather, cloth, vinyl, or plastic, and it may be waterproof.

Figure 15:
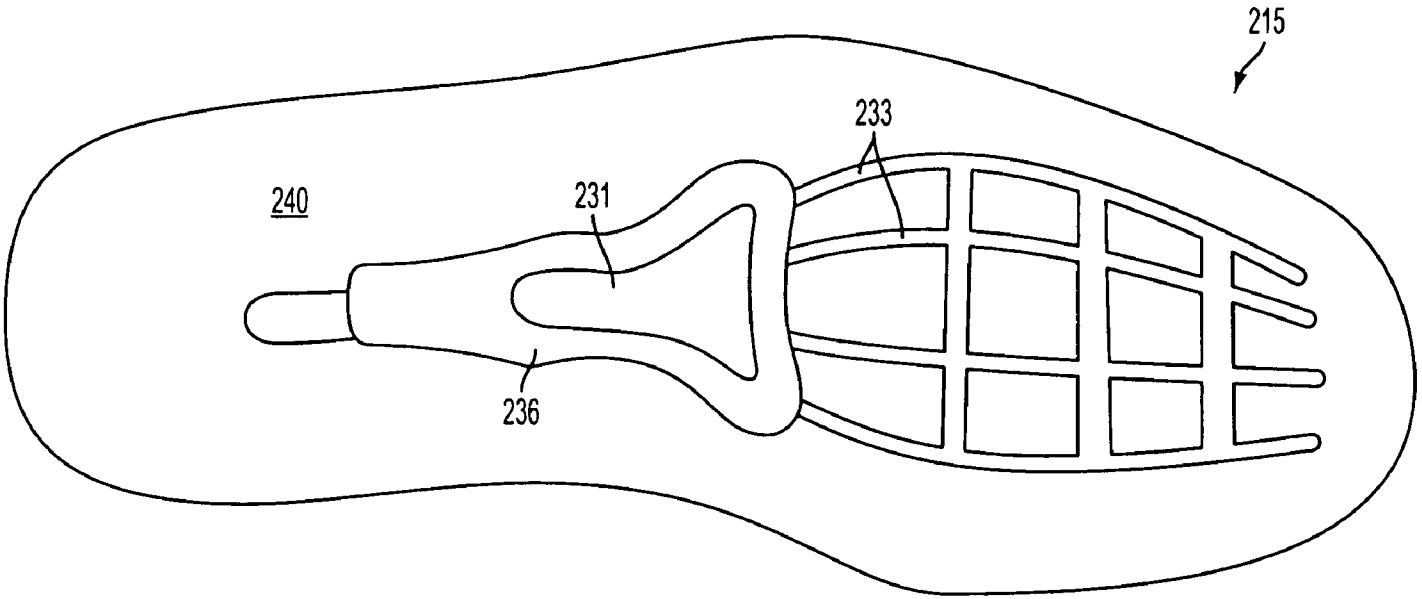
FIG. 15 is a top view of a unit sole included in the air circulating shoe of FIG. 14.
Figure 16:
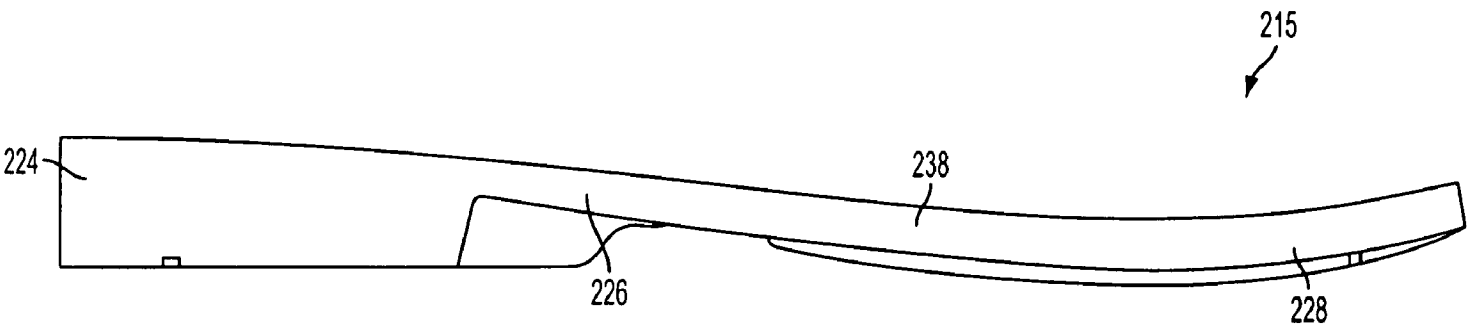
FIG. 16 is a side view of the unit sole of FIG. 15.

Unit sole 215 of shoe 200 is shown in FIGS. 15 and 16. Unit sole 215 combines the cushioning features of a midsole with the wear-resistance of an outsole into one component. Unit sole 215 includes a heel portion 224, a midfoot portion 226 and a forefoot portion 228, each of which corresponds to a portion of a user's foot. Heel portion 224 is generally the thickest portion of unit sole 215 and cushions the heel of a user of shoe 200. Forefoot portion 228 corresponds with the forefoot of a user of shoe 200 and cushions the ball and toes of the user's foot. Midfoot portion 226 of unit sole 215 is located between heel portion 224 and forefoot portion 228 and corresponds generally to the arch of the user's foot.

A vent passage 231 is included in unit sole 215 in midfoot portion 226. Vent passage 231 is an aperture that extends through the thickness of unit sole 215. A shank recess 236 may be provided that forms a step surrounding a top edge of vent passage 231. Shank recess 236 is configured to receive shank 220 so that a top surface of shank 220 rests below a top surface 240 of unit sole 215.

Unit sole 215 may be contoured to improve the comfort and support provided by shoe 200. For example, top surface 240 may be generally concave. In addition, unit sole 215 includes a plurality of circulation channels 233 that are recessed from top surface 240 of unit sole 215, creating a circulation network. Circulation channels 233 are narrow channels that extend longitudinally and transversely through unit sole 215 and intersect central vent passage 231.

The construction of unit sole 215 is similar to other unit soles known in the art, where the function thereof is to cushion the foot during the step and to provide wear-resistance. As such, the characteristics of unit sole 215 will vary according to the intended use of shoe 200. For example, midsole 14 may be relatively thick and resilient in an athletic shoe, while midsole 14 may be relatively thin in a dress shoe. Unit sole 215 may be made from any material known in the art that is appropriate for a unit sole, such as EVA, rubberized EVA, rubber, PU, TPU, leather or a combination of such materials.

Figure 17:
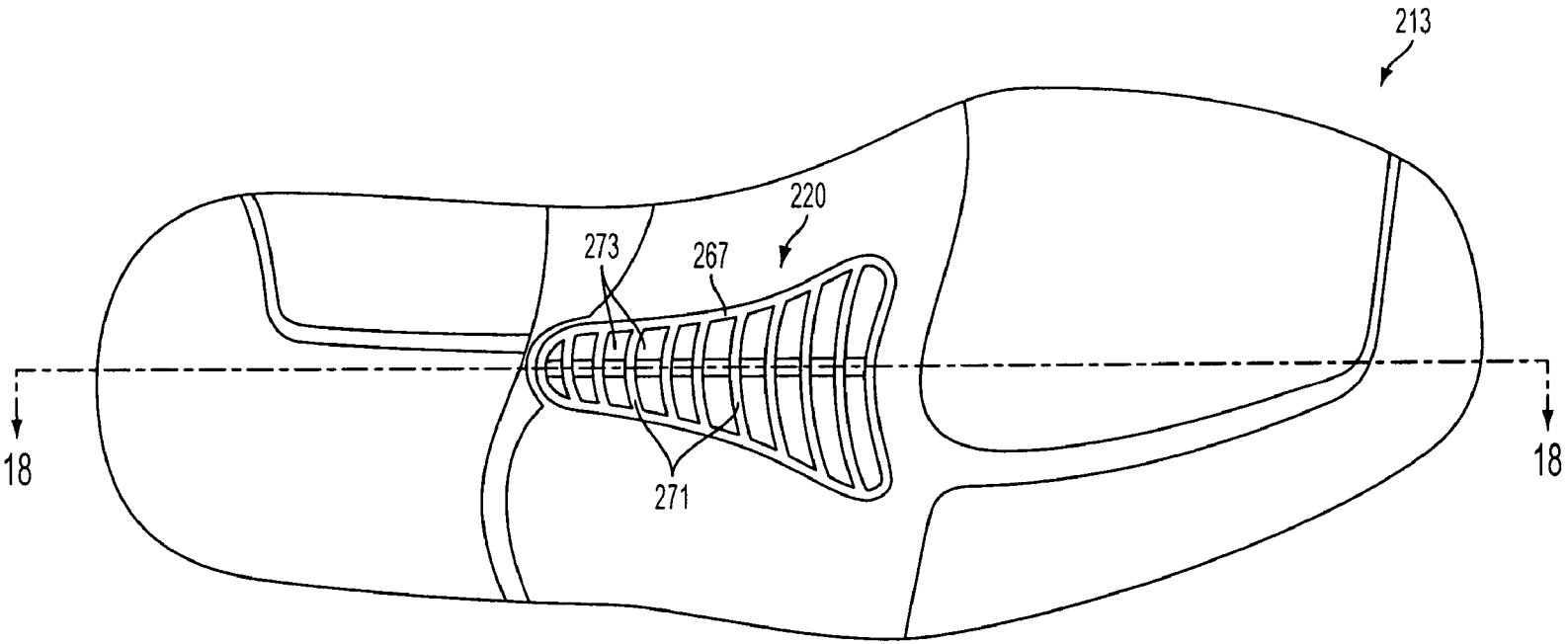
FIG. 17 is a bottom view of a sole assembly of the air circulating shoe of FIG. 14.
Figure 18:
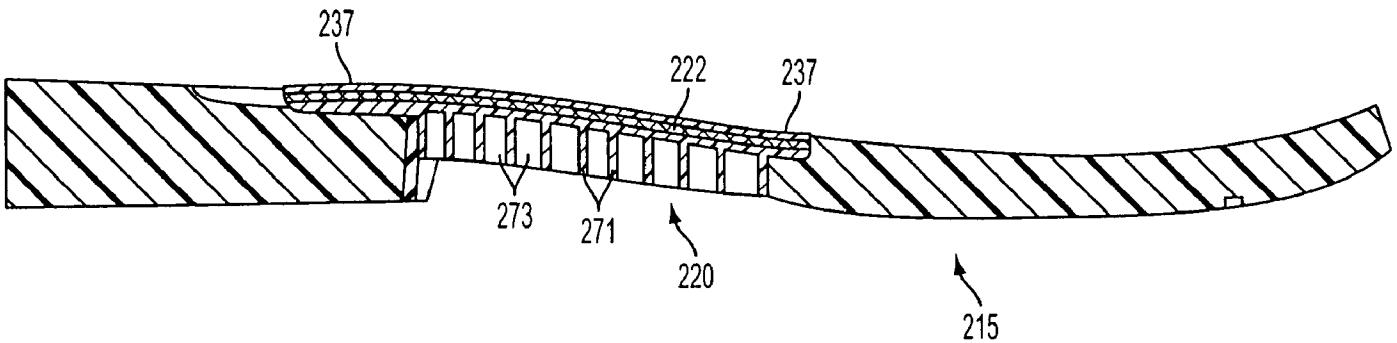
FIG. 18 is a cross-sectional view of the sole assembly of FIG. 17, combined with a waterproof layer, taken along line 18—18.

Sole assembly 213 also includes shank 220, as shown in FIGS. 17 and 18. Shank 220 is assembled in vent passage 231 of unit sole 215 in midfoot portion 226. Shank 220 generally includes a vent frame 267 that defines a vent, and a plurality of vent fins 271 located therein. Vent fins 271 create a series of vent apertures 273 that allow air to flow through vent passage 231. The fins may be oriented to direct air through vent apertures 273. For example, vent fins 271 may be angled down in the direction of forefoot portion 228 of unit sole 215. One or more of vent fins 271 may also be oriented differently from the other vent fins 271. As shown, shank 220 includes a circumferential flange 237 extending outward in a lateral direction that is configured to be received within recess 236. Such a configuration allows the top surface of shank 220 to be flush with the, or rest below, the top surface 240 of unit sole 215. Vent frame 267 may be configured so that a bottom surface of vent frame 267 is flush with a bottom surface of unit sole 215. Flange 237 need not be continuous, that is flange 237 may be constructed from a plurality of flange segments.

Shank 220 may constructed from TPU, composites, filled or non-filled nylons, other similar structural plastics or any other material known in the art suitable for a shank. Other suitable materials include TPE, EVA, and ENGAGE polyolefin elastomer. The shank may be thermoformed, such as by injection molding or extruding. The thickness of the shank may vary, for example the thickness of the shank may be between 2 and 8 mm.

Thermal barrier 223 may be located between waterproof layer 222 and footbed 218 within shoe 200. Thermal barrier 223 may be provided to reduce the heat loss from the user's foot in colder seasons or a colder climate. Thermal barrier 223 may be constructed from a perforated material that provides heat reflecting or other thermal insulating characteristics such as aluminized polyester.

Waterproof layer 222 provides a barrier for liquids passing through the central vent. Waterproof layer 222 may be coupled with the top surface of unit sole 215 or shank 220, or located within shank 220, as shown in FIG. 18. Waterproof layer 22 is constructed to create a barrier from the passage of liquid while allowing gases, such as air and water vapor, to pass through. Waterproof layer 22 may be a waterproof and vapor-permeable textile material, a membrane material that is waterproof and vapor-permeable, or it may be a perforated film such as a thermoplastic. Waterproof layer 222 may be located within shank 220 by incorporating a multi-piece shank 220 and assembling waterproof layer 222 therein, by molding waterproof layer 222 into shank 220 as an insert during a molding process, or by fixing waterproof layer 220 within the vent apertures 273.

As shown in FIG. 14, footbed 218 is included within shoe 200 above thermal barrier 223. Footbed 218 includes ventilation holes located in the midfoot region to correspond with vent apertures 273. Footbed 218 may otherwise generally be identical to footbed 18 described with respect to shoe 10 above, and therefore will not be described in further detail. In addition, insole 217 may be generally identical to insole 17 and also will not be described in further detail. It should also be understood that shoe 200 may be constructed without insole 217.

Although shoe 200 may be any type of shoe known in the art, such as an athletic shoe, or a dress shoe for example, shoe 200 incorporates a construction that is particularly well-suited to a dress shoe.

The vent passage 231 is concealed in sole assembly 213 when viewed from the sides. As a result, vent passage 231 will not affect the outward appearance of shoe 200. Therefore, classic dress styles may be incorporated into shoe 200.

The location of the vent passage 231 also limits circulation when the shoe is on a surface. Air circulates through shoe 200 by entering vent apertures 273 of vent passage 231, flowing through circulation channels 233, and passing through waterproof layer 222. A space is created under shank 220 when shoe 200 is placed upright on a surface. As a result, air is able to flow into the vent passage 231, but is limited. However, the vent passage 231 becomes completely exposed when the user lifts the shoe. Therefore, when a user is not making strides the amount of heat transfer is reduced due to the limited circulation of air through shoe 200, but that limitation is removed when the shoe is lifted.

The bottom surface of the unit sole may be contoured to further limit the amount of air that is allowed to enter the vent passage 231 when the shoe is on a surface. For example, the thickness of the unit sole may be increased in the midfoot portion to decrease the size of the gap created when the shoe is on a surface.

The size and position of waterproof layer 222 may be altered to modify the heat transfer characteristics of shoe 200. For example, the waterproof layer may be sized to substantially only cover the shank, as shown in FIG. 18, or it may be sized to cover the entire circulation network. As a further alternative, the waterproof layer may be positioned over the forefoot portion and the shank or over any other portions of the unit sole. Similar to the previous embodiment, the size and position of waterproof layer are dependent on the design of the shank and the likelihood of liquid passing through the shank into the circulation network.

It should be appreciated that additional embodiments may be constructed by combining various features described above with respect to shoes 10 and 200. For example, another embodiment may be constructed by replacing the combined midsole and outsole of shoe 10 with a unit sole. In such an embodiment, the shank may be inserted into a preformed unit sole or it may be incorporated during manufacture of the unit sole. Furthermore, shank 20 of shoe 10 may include a single central vent rather than medial and lateral vents or any other number or configuration of vents to allow adequate circulation.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A shoe comprising:

an upper;

a unit sole coupled to the upper, said unit sole including a central vent passage extending through the thickness of said unit sole and at least one circulation channel intersecting said central vent passage;

a shank having a vent frame that defines a vent;

a waterproof layer configured to cover said central vent passage and coupled to said shank; and a removable footbed having a bottom surface disposed on top of said waterproof layer;

wherein said shank is coupled with said unit sole.

2. The shoe of claim 1, further comprising an insole extending through at least a portion of said shoe, said insole being interposed between said waterproof layer and said removable footbed.

3. The shoe of claim 2, wherein said insole extends over substantially the entire length of said shoe.

4. The shoe of claim 2, wherein said insole is a lasting board.

5. The shoe of claim 2, wherein said insole is adapted for Strobel stitching.

6. The shoe of claim 1, further comprising a thermal barrier interposed between said waterproof layer and said removable footbed.

7. The shoe of claim 1, wherein said vent frame extends through the entire length of said central vent passage.

8. The shoe of claim 1, wherein the shank includes a circumferential flange extending outward from a top surface that is configured to engage a recess that is included in a top surface of the unit sole.

9. The shoe of claim 1, wherein said waterproof layer is coupled to a top surface of said shank.

10. The shoe of claim 1, wherein said waterproof layer is located within said shank.

* * * * *